US005431305A

United States Patent [19]

Kaminski

[11] Patent Number: 5,431,305

[45] Date of Patent: Jul. 11, 1995

[54] TAMPER EVIDENT LIQUID DISPENSING PACKAGE

[75] Inventor: Ronald S. Kaminski, Bowling Green, Ohio

[73] Assignee: Owens-Illinois Plastic Products Inc., Toledo, Ohio

[21] Appl. No.: 228,049

[22] Filed: Apr. 15, 1994

[51] Int. Cl.[6] ..... B67D 1/16

[52] U.S. Cl. ..... 222/109; 222/153.06; 222/507; 222/521; 222/524; 222/525; 222/541.6; 222/549

[58] Field of Search ..... 222/109, 153, 212, 503, 222/507, 519, 520, 521, 522, 523, 524, 525, 541, 549

[56] References Cited

U.S. PATENT DOCUMENTS

| | | | |
|---|---|---|---|
| 1,079,710 | 11/1913 | Mason | 222/507 |
| 2,193,746 | 3/1940 | Strehs | 222/507 |
| 2,885,128 | 5/1959 | Zimmerli | 222/541 |
| 3,259,233 | 7/1966 | Beeman | 222/541 X |
| 3,357,607 | 12/1967 | Trott et al. | 222/507 |
| 3,578,223 | 5/1971 | Armour | 222/521 |
| 4,378,069 | 3/1983 | Franco | 222/541 X |
| 4,408,700 | 10/1983 | Fillmore et al. | 222/153 |
| 4,452,382 | 6/1984 | Von Holdt | 222/541 X |
| 4,550,862 | 11/1985 | Barker et al. | 222/109 |
| 4,570,825 | 2/1986 | Stull | 222/541 X |
| 4,771,923 | 9/1988 | Zinnbauer | 222/153 |
| 5,004,127 | 4/1991 | Morel | 222/521 |
| 5,135,140 | 8/1992 | Maguire et al. | 222/519 X |

FOREIGN PATENT DOCUMENTS 1350703 4/1964 France .

*Primary Examiner*—Andres Kashnikow
*Assistant Examiner*—Joseph A. Kaufman

[57] ABSTRACT

A liquid dispensing package includes a container whose finish has an opposed pair of slots extending vertically from a free end thereof. A nozzle element with a dispensing passage extending therethrough is positioned within the finish and has an opposed pair of pins which extend into and through the slots of the finish to permit the nozzle element to translate, but not rotate, with respect to the finish, the translation being between a sealed, non-dispensing position and an unsealed, dispensing position. A cap element is rotatably affixed to the finish and has an opening in a top central panel which is aligned with the dispensing passage of the nozzle element. A skirt of the cap element has part helical grooves on its inside surface, and these grooves receive the free ends of the pins of the nozzle element. Thus, rotation of the cap element results in translation of the nozzle element. The opening of the central panel of the cap element has a frangible portion which is ruptured by contact with a boss at a free end of the nozzle element upon the first opening or attempted opening of the package to provide the package with tamper evident opening characteristics.

15 Claims, 6 Drawing Sheets

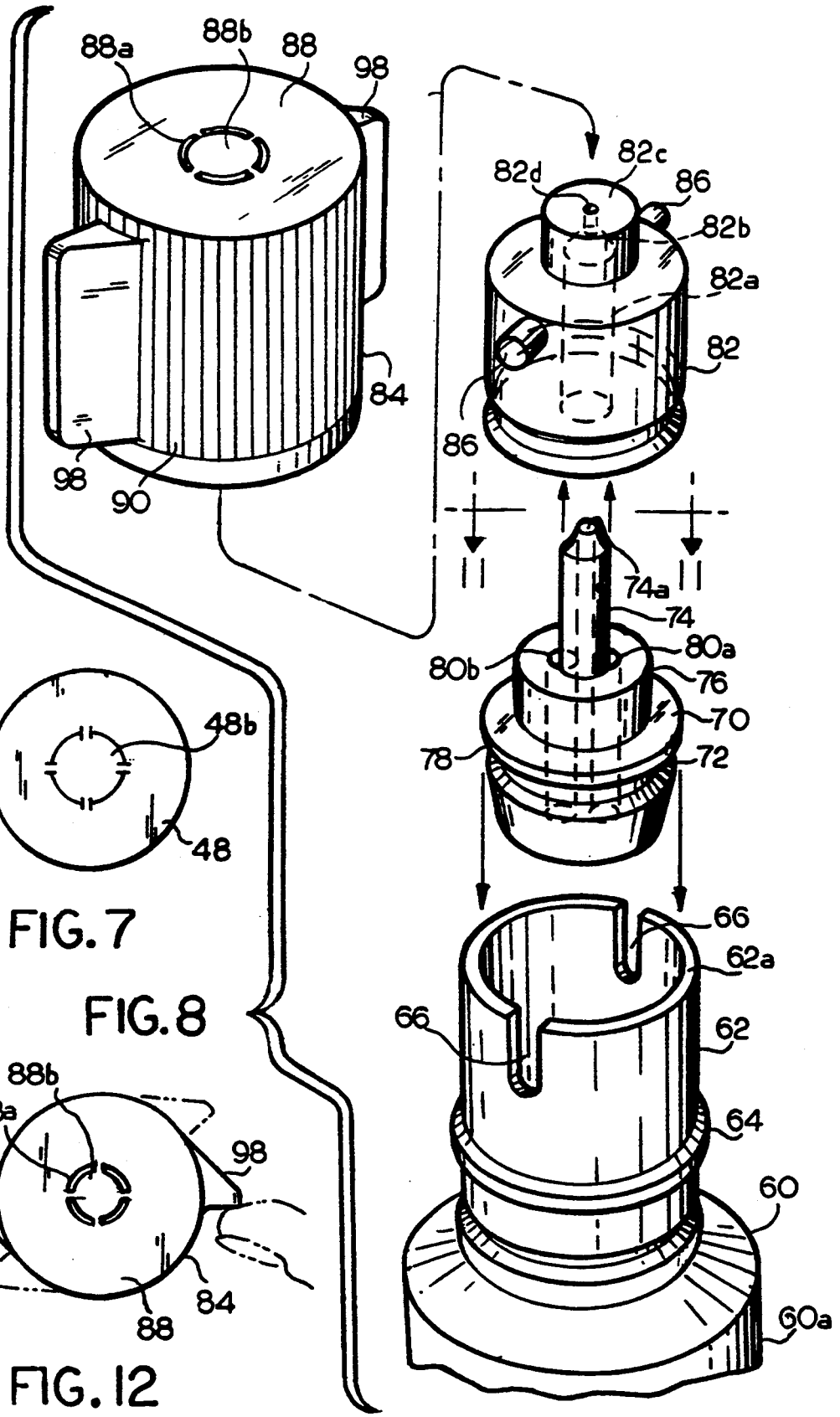
FIG. 7
FIG. 8
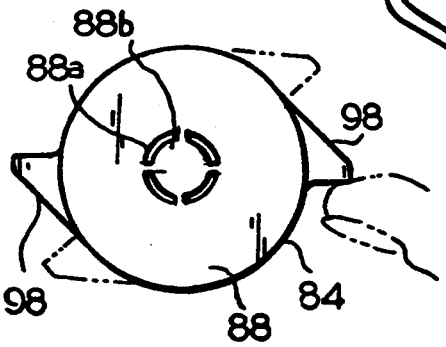
FIG. 12

TAMPER EVIDENT LIQUID DISPENSING PACKAGE

FIELD OF THE INVENTION

This invention relates to a liquid dispensing package with tamper evident opening characteristics. More particularly, this invention relates to a liquid dispensing package of the foregoing character which is made up of a container with a closure receiving finish portion in combination with a dispensing closure with a pop-up nozzle or valve element affixed to such finish portion.

BACKGROUND OF THE INVENTION

U.S. Pat. No. 4,408,700 (William E. Fillmore et al.) discloses a dispensing package which is made up of a container having an externally threaded finish portion with a closure threadably secured to such finish portion. The closure includes an axially shiftable or pop-up valve element which is movable with respect to the other structure of the closure between a closed, flow blocking, position and an open, flow permitting, position. The package of this reference does not incorporate tamper evident features, and such a package cannot be stored in an inverted position on its closure due to the fact that the top of the dispensing valve element extends beyond the surrounding structure of the closure, even in the closed position of the valve element. Further, a package of the type described in the aforesaid U.S. Patent requires that a user use both hands in opening and closing the package in a normal fashion, one hand to grasp a container and the other hand to manipulate the valve element, due to the fact that the valve element can only be moved by the application of a force extending along its longitudinal axis.

SUMMARY OF THE INVENTION

According to the present invention there is provided a liquid dispensing package which is made up of a container and a molded plastic closure with a molded plastic pop-up nozzle affixed to the finish portion of the container. The pop-up nozzle of the closure, which serves as a valve element, is stored entirely within the outline of the other structure of the closure, which is in the form of a cap with a central opening in a transversely extending panel portion thereof, in the closed, non-dispensing, position of such valve element. This permits molding the cap portion of the closure with a frangible tamper evident portion in alignment with the valve element, so that the fact of an initial opening attempt will thereafter be evident to all users of the package. Further, the positioning of the valve element of the closure entirely within the outline of the cap portion of the closure in the closed, non-dispensing, position of the valve element permits the package to be stored in an inverted position, on the closure, with the outermost tip of the valve element or nozzle out of contact with the supporting surface, such as the top surface of a table or counter, on which the package is stored.

A closure for a package according to the present invention is provided with an opposed pair of part helical or otherwise inclined grooves on the inside surface of a skirt portion of the cap portion thereof, and the axially shiftable valve element is provided with an opposed pair of radial projections that are received in such inclined grooves. Thus, the axial translation of such valve element occurs as a result of the application of a tangential or rotational force to the cap portion of the closure, which is non-threadably rotationally secured to the container finish. This facilitates the opening and closing of the closure in a single-handed manner, which is much more convenient for people with impaired hand function due to injury or arthritis, especially elderly people.

Accordingly, it is an object of the present invention to provide an improved liquid dispensing package. More particularly, it is an object of the present invention to provide a liquid dispensing package with tamper evident first opening attempt characteristics. It is also an object of the present invention to provide a package of the foregoing character which may be stored in an inverted position, on a closure element of such package. It is also an object of the present invention to provide a package of the foregoing character whose closure may be readily provided with single-handed opening and closing characteristics.

For a further understanding of the present invention and the objects thereof, attention is directed to the drawing and the following brief description thereof, to the detailed description of the preferred embodiment and to the appended claims.

BRIEF DESCRIPTION OF THE DRAWING

FIG. 7 is a plan view of an element of the embodiment of FIGS. 1–6 before a first opening attempt;

FIG. 8 is a view similar to FIG. 3 of an alternate embodiment of a package according to the present invention;

FIG. 12 is a plan view of an element of the embodiment of the present invention of FIGS. 8–11;

DETAILED DESCRIPTION OF THE PREFERRED EMBODIMENT

Figure 1:
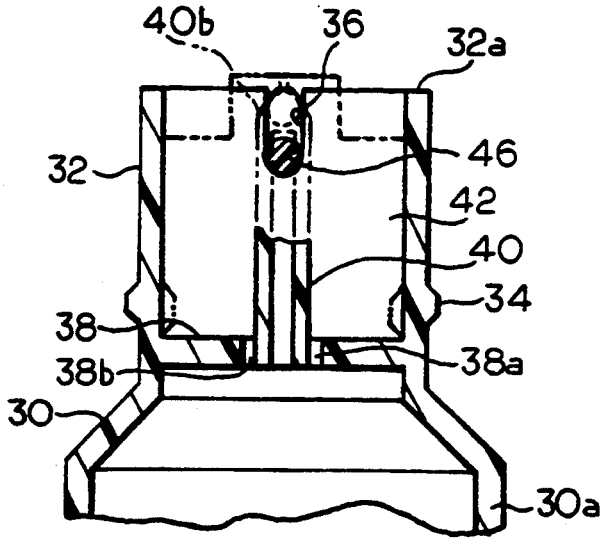
FIG. 1 is a fragmentary elevational view, partly in cross-section, of a container according to the preferred embodiment of the present invention with a valve or nozzle element of a closure according to the preferred embodiment of the present invention inserted therein.
Figure 2:
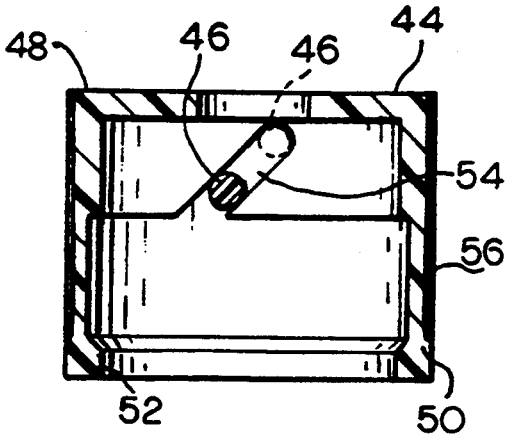
FIG. 2 is an elevational view, in cross-section, of a cap element of a closure according to the preferred embodiment of the present invention for affixing to the container of FIG. 1.

A package according to the embodiment of the present invention of FIGS. 1–7 includes a container 30 having an annular finish portion 32 surrounding an opening into a body portion 30*a* of the container 30, the other end of the container 30, not shown, being closed in a known manner. The finish portion 32 has a radially outwardly projecting annular bead 34 spaced inwardly from a free end 32*a* of the finish portion 32, and it further has a diametrically opposed pair of slots 36 extending vertically from the free end 32*a* of the finish portion 32 partly to the annular bead 34. The finish portion 32 also has a radial web portion 38 extending thereacross at a location spaced inwardly from the free end 32*a* of the finish portion 32 and preferably inwardly of the location of the annular bead 34. The finish portion 32 further has an elongate spout 40 extending from the radial web portion 38 upwardly toward the free end 32*a* of the finish portion 32. The elongate spout 40, which is shown as having a blind end opening 40*a*, has a free end 40*b* which is conical in configuration. The radial web 38 is provided with a series of circumferentially spaced apart apertures 38*a*, 38*b*, 38*c*, 38*d* (FIG. 6) surrounding the elongate spout 40. These apertures 38*a*, 38*b*, 38*c*, 38*d* provide a drain back feature to permit excess liquid being dispensed from the container 30 to drain back into the body portion 30*a* of the container 30.

As illustrated and described, a container 30 can be formed integrally in a single piece from a suitable thermoplastic material, such as high density polyethylene or polyvinyl chloride, on known types of molding machines, such as a molding machine of the injection blow molding type.

Figure 3:
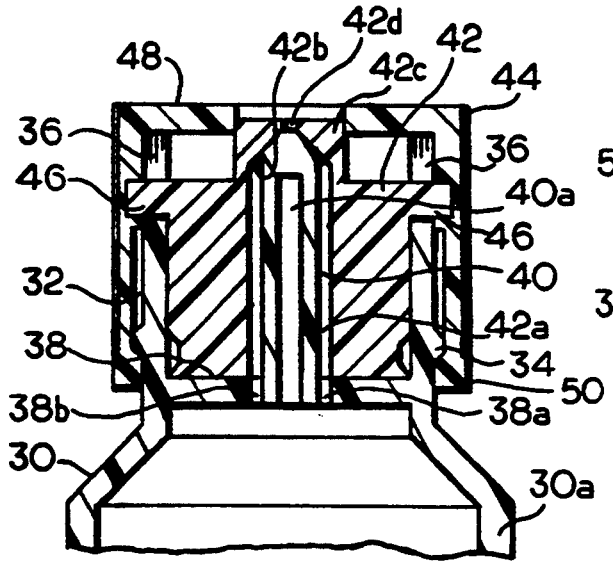
FIG. 3 is a fragmentary view, in cross-section, of a package made up of the cap portion of FIG. 2 in assembled relationship to the container and nozzle element of FIG. 1, taken at right angles to the positions of such elements in FIGS. 1 and 2 and showing the nozzle element in its closed, non-dispensing, position.
Figure 4:
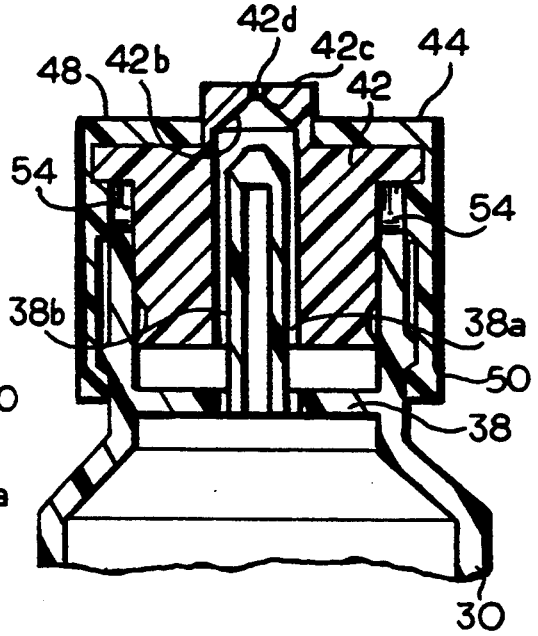
FIG. 4 is a view similar to FIG. 3 but showing the nozzle element in its open, dispensing, position.
Figure 5:
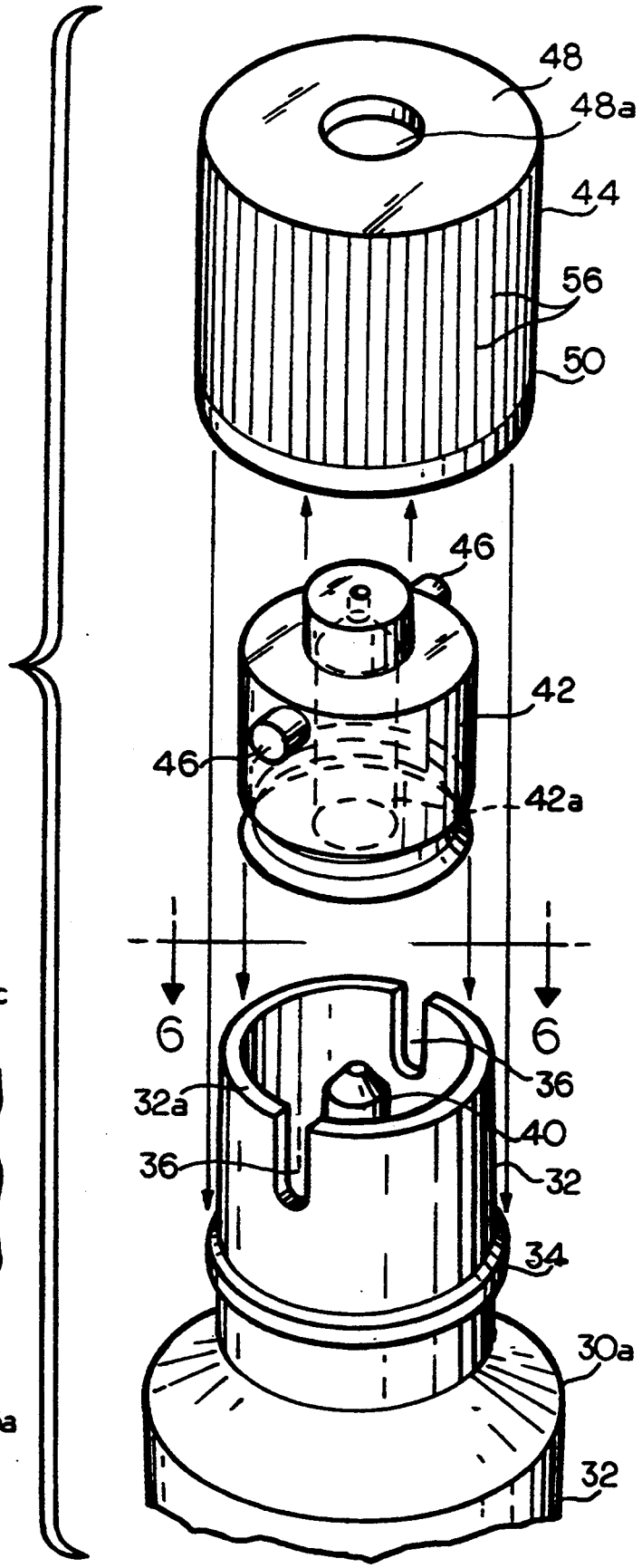
FIG. 5 is an exploded perspective view of the package elements of the embodiment of FIGS. 1–4.
Figure 6:
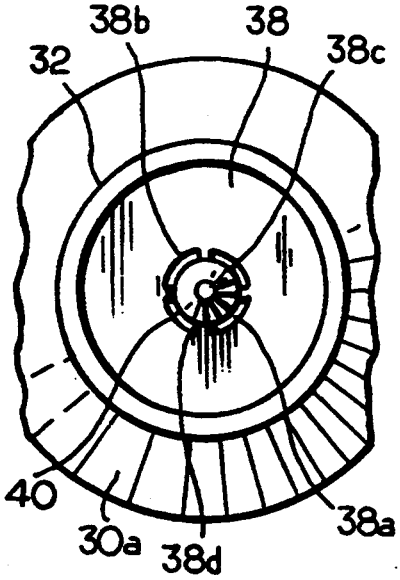
FIG. 6 is a fragmentary view, at an enlarged scale, taken on line 6—6 of FIG. 5.

A dispensing closure for the container 30 is made up of a nozzle element 42 and a cap element 44. The nozzle element 42 is an annular element with an opening 42*a* that surrounds the exterior of the elongate spout 40, when the nozzle element 42 is positioned within the finish of the container, with sufficient radial clearance to permit liquid within the container 30 to be dispensed through an annular opening within the opening 42*a*. The nozzle element 42 further has an externally projecting opposed pair of pins 46 each of which is freely slidably received in one of the slots 36 of the finish portion 32 of the container 30. As shown, each of the pins 46 is of sufficient length to extend through the slot 36 which receives it and for a finite distance therebeyond. The opening 42*a* of the nozzle element 42 has a frustoconical surface portion 42*b* which is designed to engage the conical surface 40*b* of the elongate spout 40 in surface to surface sealing engagement when the nozzle element 42 is at its lowermost position within the finish portion 32 of the container 30, as shown in FIGS. 1 and 3. In this position, no liquid can be dispensed from the container 30. The nozzle element 42 also has a boss 42*c* at its free end and an aperture 42*d* extending through the boss 42*c* into communication with the opening 42*a*. As shown in FIGS. 1, 3 and 4, the outside diameter of the nozzle element 42 is large enough to fit snugly, but slidably, within the inside diameter of the finish portion 32 to substantially prevent the dispensing of liquid from the container 30 therebetween.

As illustrated and described, a nozzle element 42 can be formed integrally in a single piece from a suitable thermoplastic material, such as high density polyethylene or polypropylene, on known types of molding machines, such as an injection molding machine.

The cap element 44 has a radially extending top panel portion 48 and an annular skirt portion 50 which depends from the periphery of the top panel portion 48. The skirt portion 50 has a radially inwardly projecting annular bead 52 near its lower extremity. The annular bead 52 has an inner diameter which is slightly greater than an outer diameter of the annular bead 34 of the finish portion 32 of the container 30, so that the cap element 44 may be rotatably secured to the finish portion 32 of the container 30 by a snap fit between the annular bead 34 and the annular bead 52.

The skirt portion 50 of the cap element 44 has a diametrically opposed pair of partial depth part helical or otherwise inclined slots 54 on its interior surface. The slots 54 receive the free ends of the pins 46 of the nozzle element 42. Thus, by turning the cap element 44 in a first direction with respect to the container 30, for example, in a counterclockwise direction, the nozzle element 42 will be lifted with respect to the container 30 from its closed position, as shown in FIG. 3, where sealing contact between the surface 40*b* of the spout 40 and the surface 42*b* of the nozzle element 42 prevents dispensing from the container 30, to its open position, as shown in FIG. 4, where liquid may be dispensed from the container 30 through an annulus in the opening 42*a* of the nozzle element 42 and then through the aperture 42*d*. Of course, when the cap element 44 is turned in a reverse direction with respect to the container 30, the nozzle element 42 will be moved from its FIG. 4 open, dispensing, position to its FIG. 3 closed, nondispensing, position.

To provide tamper indicating characteristics to the embodiment of FIGS. 1–7, the top panel 48 of the cap element 44 is provided with an opening 48*a* which is aligned with the boss 42*c* of the nozzle element 42. The opening 48*a* is large enough to permit the boss 42*c* to pass thereinto during the opening of the package, the free end of the boss 42*c* being entirely within the interior of the opening 48*a* of the cap element 44 in the FIG. 3 closed condition of the package. The opening 48*a* is initially closed with a frangible portion 48*b*. The frangible portion 48*b* ruptures from the top panel 48 upon the first opening of the package of FIGS. 1–7, in changing from its FIG. 3 condition to its FIG. 4 condition, thereby indicating a previous opening or opening attempt of the package to a purchaser thereof.

The exterior of the skirt portion 50 of the cap element 44 preferably is provided with a circumferential series of vertically extending grooves 56 extending thereabout. The grooves 56 serve to increase friction between the exterior of the skirt portion 50 and the hand of a user to assist in the opening and in the closing of the cap element 44 with respect to the container 30.

As illustrated and described, a cap element 44, including the frangible portion 48*b*, can be formed integrally in a single piece from a suitable thermoplastic material, such as high density polyethylene or polypropylene, on known types of molding machines, such as an injection molding machine. When formed in this manner, the skirt 50 of the cap element 44 will have sufficient elasticity to permit the cap element 44 to be rotatably secured to the finish portion 32 of the container 30, notwithstanding the snap fit between the annular bead 52 and the annular bead 34.

An alternate embodiment of the invention of this application is illustrated in FIGS. 8–12, where the dispensing package of such embodiment includes a container 60. The container 60 has a finish portion 62 with a free end 62*a*, and the finish portion 62 further has a radially outwardly projecting annular bead 64 spaced inwardly from the free end 62*a*. The other end of a main body portion 60*a* of the container 60, not shown, is closed in a known manner. The finish portion 62 also has a diametrically opposed pair of slots 66 extending vertically from the free end 62*a* partly to the annular bead 64. The container 60 also has a radially inwardly projecting annular bead 68 spaced further from the free end 62*a* than the annular bead 64. The inside diameter of the annular bead 68 defines an opening into the body portion 60*a* of the container 60.

As illustrated and described, a container 60 can be formed integrally in a single piece from a suitable thermoplastic material, such as high density polyethylene or polyvinyl chloride, on known types of molding machines, such as a molding machine of the injection blow molding type.

The container 60 is fitted with a fitment 70 which has an annular groove 72 that receives the annular bead 68 of the container 60 in a snap fit. The fitment 70 has a spout 74 which extends upwardly therefrom, the spout 74 having a free end 74*a* which is frustoconical in configuration. A reduced diameter boss 76 is positioned between the opposed end of the spout 74 and a main body portion 78 of the fitment 70, the groove 72 being located in the main body portion 78. The fitment 70 is provided with an opposed pair of passages 80*a*, 80*b* on opposite sides of the spout 74. The passages 80*a*, 80*b* extend through the boss 76 and the main body portion 78, and provide openings for dispensing liquid from the container 60 through the fitment 70 and a drain back feature to permit excess liquid being dispensed from the container 60 to drain back into its main body portion 60*a*.

As illustrated and described, a fitment 70, including its spout 74, boss 76 and main body portion 78, can be formed integrally in a single piece from a suitable thermoplastic material, such as high density polyethylene or polypropylene, on known types of molding machines, such as an injection molding machine.

Figure 9:
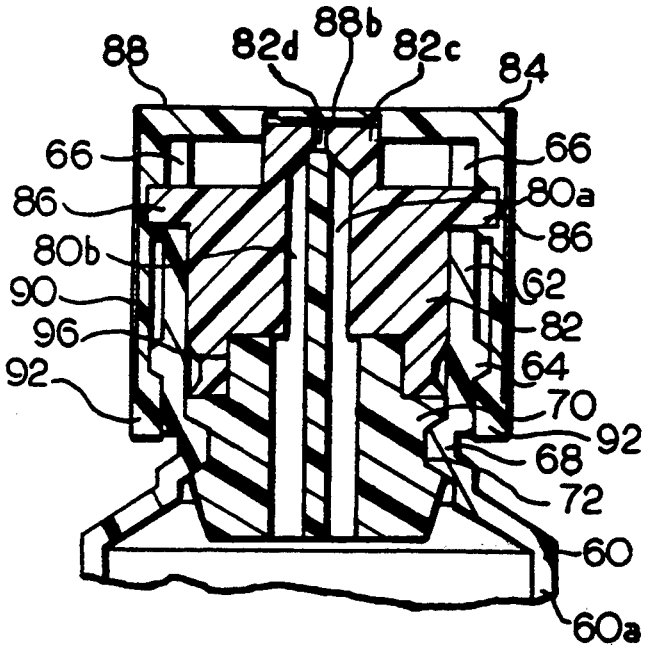
FIG. 9 is a view similar to FIG. 3 of the embodiment of the present invention of FIG. 8.
Figure 10:
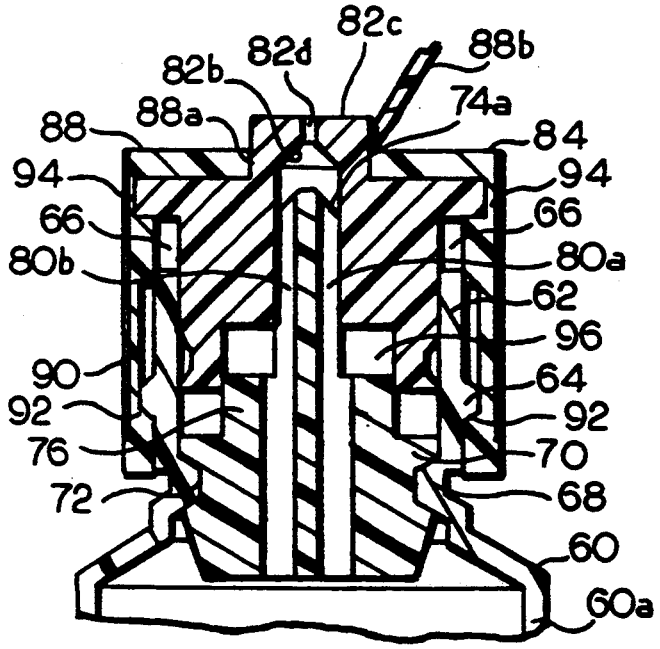
FIG. 10 is a view similar to FIG. 4 of the embodiment of the present invention of FIGS. 8 and 9.
Figure 11:
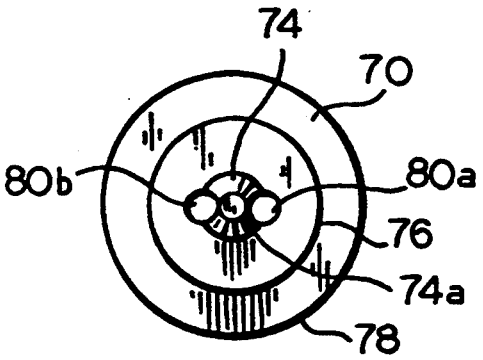
FIG. 11 is a view taken on line 11—11 of FIG. 8.

The package of FIGS. 8–12 also includes a dispensing closure which is made up of a nozzle element 82 and a cap element 84. A nozzle element 82 is an annular element with an opening 82*a* that surrounds the exterior of the spout 74 of the fitment 70 with sufficient radial clearance to permit liquid being dispensed from the container 60 through the passages 80*a*, 80*b* of the fitment 70 to pass through the opening 82*a*. The opening 82*a* of the nozzle element 82 has a frustoconical surface portion 82*b*, which is designed to engage the frustoconical surface 74*a* of the spout 74 in surface to surface sealing engagement when the nozzle element 82 is at its lowermost position within the finish portion 62 of the container 60, as shown in FIG. 10. In this position, no liquid can be dispensed from the container 60.

The nozzle element 82 further has an externally projecting opposed pair of pins 86 each of which is freely slidably received in one of the slots 66 of the finish portion 62 of the container 60 as shown. Each of the pins 86 is of sufficient length to extend through the slot 66 which receives it and for a finite distance therebeyond. The nozzle element 82 also has a boss 82*c* at its free end and an aperture 82*d* extending through the boss 82*c* into communication with the opening 82*a*. As is shown in FIGS. 9 and 10, the outside diameter of the nozzle element 82 is large enough to fit snugly, but slidably, within the inside diameter of the finish portion 62 to substantially prevent the dispensing of liquid from the container 60 therebetween.

As illustrated and described, a nozzle element 82 can be formed integrally in a single piece from a suitable thermoplastic material, such as high density polyethylene or polypropylene, on known types of molding machines, such as an injection molding machine.

The cap element 84 has a radially extending top panel portion 88 and an annular skirt portion 90 which depends from the periphery of the top panel portion 88. The skirt portion 90 has a radially inwardly projecting annular bead 92 near its lower extremity. The annular bead 92 has an inner diameter which is slightly greater than an outer diameter of the annular bead 64 of the finish portion 62 of the container 60, so that the cap element 84.may be rotatably secured to the finish portion 62 of the container 60 by a snap fit between the annular bead 64 and the annular bead 92.

The skirt portion 90 of the cap element 84 has a diametrically opposed pair of partial depth part helical or otherwise inclined slots 94 on its interior surface. The slots 94 receive the free ends of the pins 86 on the nozzle element 82. Thus, by turning the cap element 84 in a first direction with respect to the container 60, for example, in a counterclockwise direction, the nozzle element 82 will be lifted with respect to the container 60 from its closed position, as shown in FIG. 9, where sealing contact between the surface 74*b* of the spout 74 and the surface 82*b* of the nozzle element 82 prevents dispensing from the container 60, to its open position, shown in FIG. 10, where liquid may be dispensed from the container 60 through an annulus in the opening 82*a* of the nozzle element 82 and then through the aperture 82*d*. Of course, when the cap element 84 is turned in a reverse direction with respect to the container 60, the nozzle element 82 will be moved from its FIG. 10 open, dispensing, position to its FIG. 3 closed, nondispensing, position. As is shown in FIGS. 9 and 10, the nozzle element 82 is further provided with a recess 96 which snugly but slidably receives the boss 76 of the fitment 70 to substantially prevent the dispensing of liquid from the container 60 therebetween.

To provide tamper indicating characteristics to the embodiment of FIGS. 8–12, the top panel portion 88 of the cap element 84 is provided with an opening 88*a* which is aligned with the boss 82*c* of the nozzle element 82. The opening 88*a* is large enough to permit the boss 82*c* to pass thereinto during the opening of the package, the free end of the boss 82*c* being entirely within the interior of the opening 88*a* in the FIG. 9 closed condition of the package. The opening 88*a* is initially closed with a frangible portion 88*b*. The frangible portion 88*b* ruptures from the top panel 88 upon the first opening of the package of FIGS. 8–12, in changing from its FIG. 9 condition to its FIG. 10 condition, thereby indicating a previous opening or opening attempt of the package to a purchaser thereof.

The exterior of the skirt 90 of the cap element 84 may be provided with a diametrically opposed pair of tabs 98 projecting outwardly therefrom. The tabs 98 serve to provide purchase to the thumb of a hand of a user to assist in the opening and of the closing of the cap element 84 with respect to the container 60, as shown in FIG. 12. The tabs 98 of the embodiment of the invention of FIGS. 8–12, thus, serve a similar function to the grooves 56 of the embodiment of FIGS. 1–7. These features may be used interchangeably with one another depending on the torque required to open and close a package according to either of such embodiments.

As illustrated and described, the cap element 84 can be formed integrally in a single piece from a suitable thermoplastic material, such as high density polyethylene or polypropylene, on known types of molding machines, such as an injection molding machine.

Another alternate embodiment of the invention of this application is illustrated in FIGS. 13–16, where the dispensing package of such embodiment includes a container 100. The container 100 has a finish portion 102 with a free end 102*a*. The other end of a main body portion 100*a* of the container 100, not shown, is closed in a known manner.

The finish portion 102 of the container 100 has a radially outwardly projecting annular bead 104 spaced inwardly from free end 102*a* of the finish portion 102. The finish portion 102 also has a diametrically opposed pair of slots 106 extending vertically from the free end 102*a* partly to the annular bead 104. The container 100 also has a radially inwardly projecting annular bead 108 spaced further from the free end 102*a* of the finish portion 102 and the annular bead 104. The inside diameter of the annular bead 108 defines an opening into the body portion 100*a* of the container 100.

As illustrated and described, a container 100 can be formed integrally in a single piece from a suitable thermoplastic material, such as high density polyethylene or polyvinyl chloride, on known types of molding machines, such as a molding machine of the injection blow molding type.

A dispensing closure for the container 100 is made up of a nozzle element 112 and a cap element 114. The nozzle element 112 has an axially extending passage 112*a* extending from a free end 112*c* of an external boss 112*b* of the nozzle element 112 to a juncture with a coplanar series of radial passages 112*d* extending through an interior portion of a nozzle element 112. The radial passages 112*d* are aligned with an inwardly projecting annular recess 116 in the nozzle element 112, and the nozzle element 112 is provided with an outwardly and downwardly projecting tapered annular sealing fin 118 below the level of the radial passages 112*d*. The sealing fin 118 sealingly engages the annular bead 108 of a container 100 in the FIG. 13 condition of the package, to block the flow of product from within the container 100 outwardly through the nozzle element 112. However, in the condition of the package shown in FIGS. 14 and 15, products can flow from the container 100 into the recess 116 of the nozzle element 112, from whence it can be dispensed through the radial passages 112*d* and the axial passage 112*a*.

The nozzle element 112 further has an externally projecting opposed pair of pins 120 each of which is freely slidably received in the slots 106 of the finish portion 102 of the container 100. Each of the pins 120 is of sufficient length to extend through the slot 106 which receives it and for a finite distance there beyond.

As illustrated and described, a nozzle element 112 can be formed integrally in a single piece from a suitable thermoplastic material, such as high density polyethylene or polypropylene, on known types of molding machines, such as an injection molding machine.

The cap element 114 has a radially extending top panel portion 122 and an annular skirt portion 124 which depends from the periphery of the top panel portion 122. The skirt portion 124 has an annular recess 126 projecting radially thereinto, and the annular recess 126 receives the annular bead 104 of the finish portion 102 of the container 100 in a snap fit when the cap element 114 is affixed to the container 100 to provide for a rotatable fit between the cap element 114 and the container 100.

The skirt portion 124 of the cap element 114 has a diametrically opposed pair of partial depth part helical or otherwise inclined slots 128 on its interior surface. The slots 128 receive the free ends of the pins 120 of the nozzle element 112. Thus, by turning the cap element 114 with respect to the container 100, for example, in a counterclockwise direction, the nozzle element 112 will be lifted from its closed position with respect to the container 100, from its closed position, as shown in FIG. 13, where sealing contact between the sealing fin 118 and the annular bead 108 prevents dispensing from the container 100, to its open position, as shown in FIGS. 14 and 15, where liquid may be dispensed from the container 100 through the radial passages 112*d* and the axial passage 112*a* of the nozzle element 112.

Figure 13:
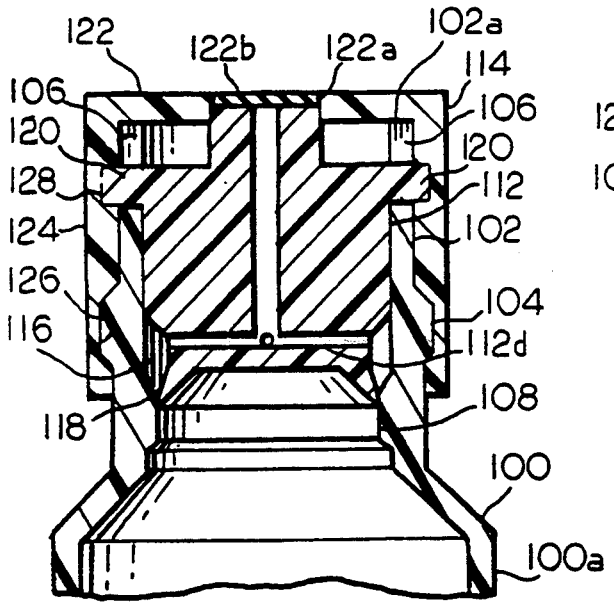
FIG. 13 is a view similar to FIGS. 3 and 9 of yet another embodiment of the present invention in the closed, non-dispensing, position of such embodiment.
Figure 14:
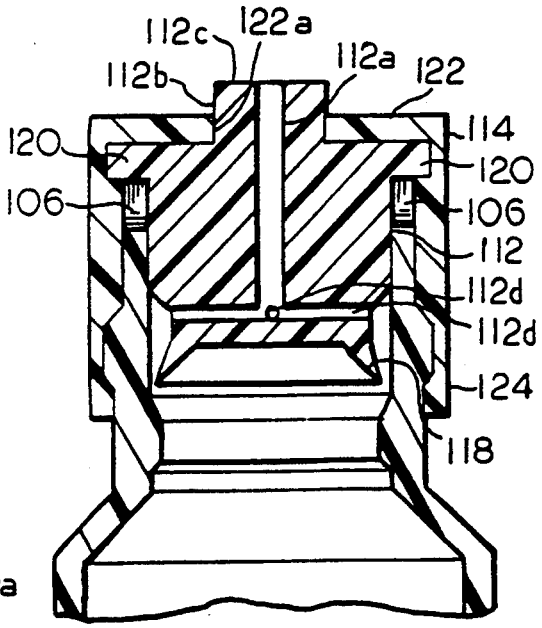
FIG. 14 is a view similar to FIGS. 4 and 10 of the embodiment of the present invention of FIG. 13.
Figure 15:
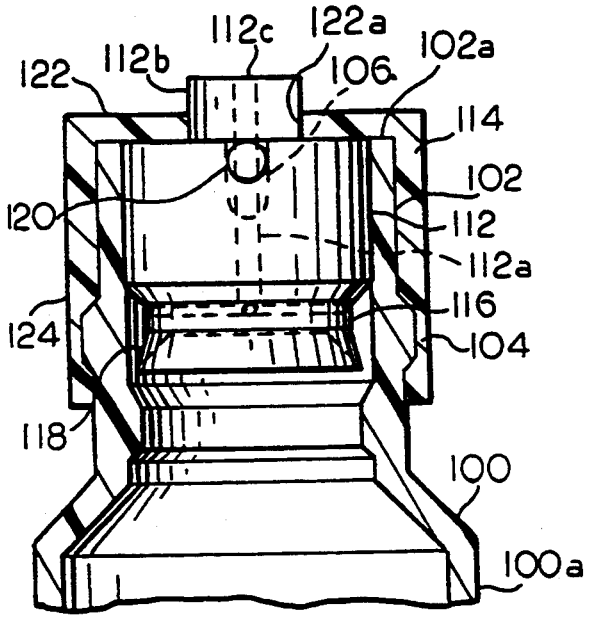
FIG. 15 is a view of the embodiment of the present invention of FIGS. 13 and 14 which is similar to the view of FIG. 13, but at right angles thereto and in the open, dispensing, position of such embodiment.
Figure 16:
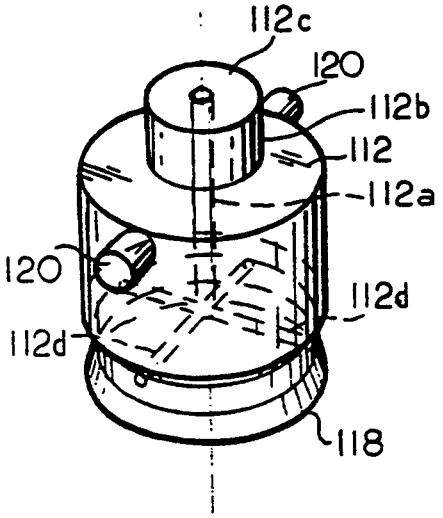
FIG. 16 is a perspective view of an element of the embodiment of the present invention of FIGS. 13–15.

To provide tamper indicating characteristics to the embodiment of FIGS. 13–16, the top panel 122 of the cap element 114 is provided with an opening 122*a* which is aligned with the boss 112*b* of the nozzle element 112, the free end of the boss 112*b* being entirely within the opening 122*a* of the cap element 114 in the FIG. 13, closed, condition of the package. The opening 122*a* is initially closed with a frangible portion 122*b*. The frangible portion 122*b* ruptures from the top panel 122 upon the first opening of the package of FIGS. 13–16 in changing from its FIG. 13 condition to its condition of FIGS. 14 and 15, thereby indicating a previous opening or opening attempt of the package to a purchaser thereof.

While not shown, the exterior of the skirt 124 of the cap element may be provided with grooves corresponding to the grooves 56 of the embodiment of FIGS. 1–7 or with tabs corresponding to the tabs 98 of the embodiment of FIGS. 8–12 to assist in the opening or closing thereof, and such opening or closing may also thereby be easily accomplished in a single-handed manner.

As illustrated and described, a cap element 114 can be formed integrally in a single piece from a suitable thermoplastic material, such as high density polyethylene or polypropylene, on known types of molding machines, such as an injection molding machine. When formed in this manner, the skirt portion 124 of the cap element 114 will have sufficient elasticity to permit the cap element 114 to be rotatably secured to the finish portion 102 of the container 100, notwithstanding the snap fit between the annular bead 104 of the finish portion 102 of the container 100 and the annular recess 126 of the skirt portion 124 of the cap element 114.

The embodiment of the invention FIGS. 13–15 is advantageous with respect to the embodiment of FIGS. 8–12 in that the embodiment of FIGS. 13–15 is made up of only three elements, namely the container 100, the nozzle element 112 and the cap element 114, whereas the embodiment of FIGS. 8–12 requires four elements, namely the container 60, the fitment 70, the nozzle element 82 and the cap element 84. However, the molding of the nozzle element 112 of the embodiment of FIGS. 13–15 is somewhat more complex than the molding of the nozzle element 82 of the embodiment of FIGS. 8–12, because of the requirement that the nozzle element 112 be provided with radial passages **112*d* as well as an axial passage 112*a***.

The embodiment of FIGS. 1–7, like the embodiment of FIGS. 13–15, is also made up of only three elements, namely the container 30, the nozzle element 42 and the cap element 44, and is somewhat advantageous with respect to the embodiment of FIGS. 13–15 in that the nozzle element 42 does not require radial passages corresponding to the radial passages **112*d* from the nozzle element 112. However, the finish portion 32 of the container 30 is more complex than the finish portion 102 of the container 100, by a virtue of its requirement of a radial web portion 38 and a spout 40**.

Figure 17:
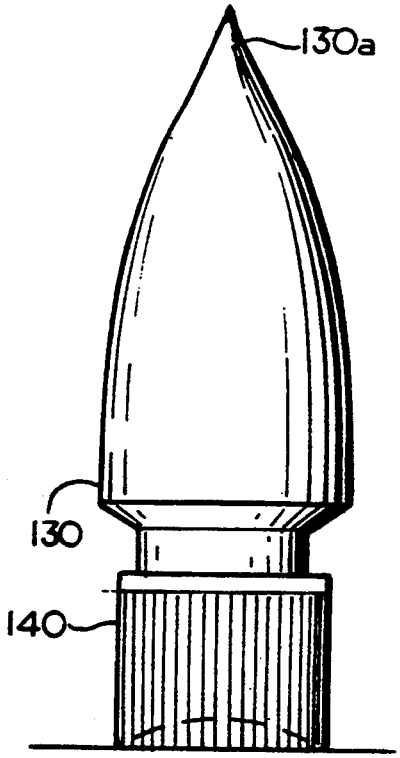
FIG. 17 is an elevational view of a top standing liquid dispensing package in a closed, nondispensing condition, which otherwise may be in accordance with any of the embodiments of FIGS. 1–7, 8–12, or 13–16, respectively.

FIG. 17 illustrates a container 130 having a dispensing closure 140 affixed to a finish portion thereof. The container 130 has a pinched opposed end **130*a*, and is adapted to be stored in an inverted position, resting on its dispensing closure 140, which may correspond in construction to any of the dispensing closures of the embodiments of FIGS. 1–7, 8–12, or 13–16, respectively. The fact that the boss 42*c* of the embodiment of FIGS. 1–7 is entirely within the opening 48*a* of the cap element 44 thereof in the closed, nondispensing, condition of such package makes the dispensing closure of FIGS. 1–7 suitable for use in a package which is to be stored in its inverted position. Likewise, the fact that the boss 82*c* of the nozzle element 82 of the embodiment of FIGS. 8–12 is entirely within the opening 88*a* of the cap element 84 thereof in the closed, nondispensing, condition of such package makes the dispensing closure of FIGS. 8–12 suitable for use in a package which is to be stored in its inverted position, and the fact that the boss 112*c* of the nozzle element 112 of the embodiment of FIGS. 13–16 is entirely within the opening 122*a* of the cap element 114 in the closed, nondispensing condition of such package also makes the dispensing closure of FIGS. 13–16** suitable for use in a package which is to be stored in its inverted position.

Figure 18:
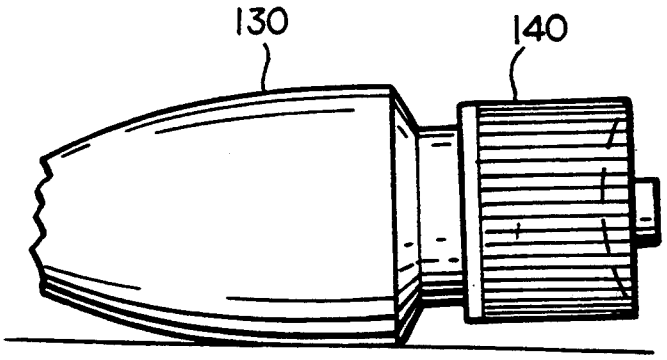
FIG. 18 is a fragmentary view of the dispensing package of FIG. 17 in an open, dispensing condition of the package.
Figure 19:
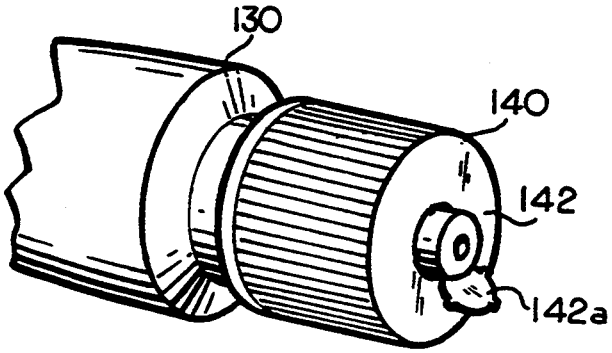
FIG. 19 is a perspective view of the package of the embodiment of FIGS. 17 and 18 in the FIG. 18 condition of the package.
Figure 21:
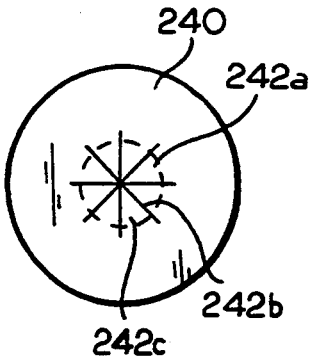
FIG. 21 is plan view of the package of FIG. 20 before its first opening attempt.
Figure 20:
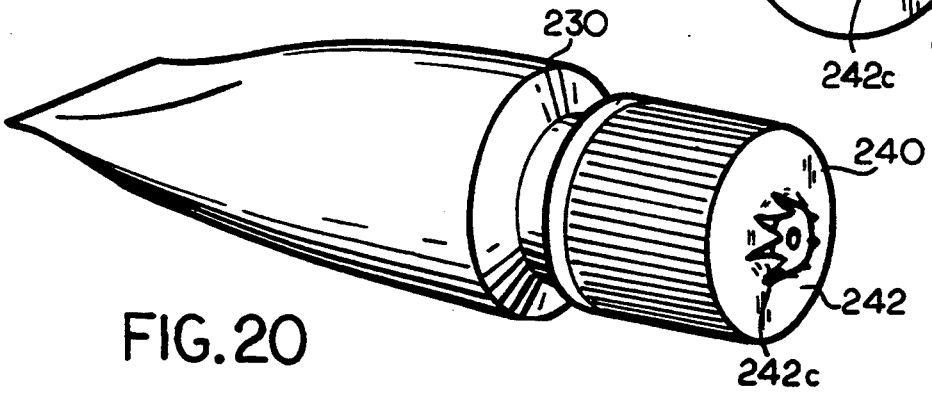
FIG. 20 is a view similar to FIG. 19 of an alternative embodiment of a liquid dispensing package according to the present invention.

The closure 140 of the package of FIGS. 17–19 is shown as having a frangible portion **142*a* in a top panel portion 142 thereof. The frangible portion 142*a* may be considered to correspond in function and construction to the frangible portion 48*b* of the embodiment of FIGS. 1–7, to the frangible portion 88*b* of the embodiment of FIGS. 8–12 or to the frangible portion 122*b* of the embodiment of FIGS. 13–16. A disadvantage of such a frangible portion 142*a*, 48*b*, 88*b* or 122*b* is that it separates entirely from the package upon the first opening of the package, creating a requirement for care in the handling of the package to ensure proper disposition of such frangible portion. This requirement can be overcome with the embodiment of FIGS. 20 and 21 where a container 230, otherwise corresponding to the container 130 of the embodiment of FIGS. 17–19, is fitted with a dispensing closure 240. The dispensing closure 240 differs from the dispensing closure 140 of the embodiment of FIGS. 17–19, in that it has a frangible portion 242*a* which is formed by a series of intersecting radial scores 242*b* in a top panel portion 242 thereof. These radial scores define deflectable triangular tabs 242*c* which rupture from one another along the scores 242*b* upon the first opening or attempted opening of the package of FIGS. 20 and 21, but which do not separate from the top panel portion 242** because they are not scored along the bases thereof.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A liquid dispensing package comprising:

a container having a finish portion with at least one slot opening in said finish portion, said slot opening extending generally parallel to a longitudinal axis of the finish portion;

a nozzle element positioned within said finish portion, said nozzle element having passage means extending therethrough to permit the dispensing of liquid within the container through said nozzle element, said nozzle element further having at least one pin extending therefrom into and through said at least one slot opening in said finish portion, said nozzle element being non-rotatable with respect to said finish portion and being translatable with respect to said finish portion along the longitudinal axis thereof between a first position and a second position; and a cap element having a top panel portion and an annular skirt portion extending perpendicularly from said top panel portion, said top panel portion having an opening therein, said cap element being rotatable with respect to said finish portion of said container with a substantial portion of said annular skirt portion surrounding a portion of said finish portion, and with said opening in said top panel portion in alignment with said passage means of said nozzle element, said annular skirt portion having at least one inclined groove on an inside surface thereof, said at least one inclined groove receiving a free end portion of said at least one pin, whereby rotation of said cap element with respect to said container in a first rotational direction will translate said nozzle element in a first linear direction along the longitudinal axis of said finish portion and rotation of said cap element with respect to said container in an opposed rotational direction will translate said nozzle element in an opposed linear direction along the longitudinal axis of said finish portion.

2. A liquid dispensing package according to claim 1 and further comprising:

sealing means associated with said container, said sealing means engaging said nozzle element in one of said first position and said second position.

3. A liquid dispensing package according to claim 2 wherein said annular skirt portion of said cap element comprises tab means projecting radially outwardly therefrom, said tab means facilitating single handed turning of said cap element with respect to said container.

4. A liquid dispensing package according to claim 2 wherein said container comprises a radial web portion extending thereacross at a location spaced inwardly from a free end of said finish portion and an elongate member extending from said radial portion of said container toward said free end of said finish portion, said elongate member being received within said passage means of said nozzle element and defining an annular flow passage therewith, wherein said elongate member has a free end within said passage means of said nozzle element and said passage means of the nozzle element has an annular sealing surface, and wherein said sealing means associated with said container comprises said free end of said elongate member, said free end of said elongate member sealingly engaging said annular sealing surface of said nozzle means in said one of said first position and said second position.

5. A liquid dispensing package according to claim 4 wherein said container, said finish portion, said radial web portion and said elongate member are formed integrally in a single piece from a thermoplastic material, wherein said nozzle element, including said at least one pin, is formed integrally in a single piece from a thermoplastic material and wherein said cap element, including said top panel portion and said annular skirt portion, is formed integrally in a single piece from a thermoplastic material.

6. A liquid dispensing package according to claim 5 wherein said radial web portion of said container comprises aperture means extending therethrough, said aperture means permitting excess liquid dispensed from said container to drain back thereinto.

7. A liquid dispensing package according to claim 2 wherein said nozzle element has a boss at a free end thereof, said passage means extending through said boss, said boss being entirely within said top panel portion of said cap element in said one of said first position and said second position, said boss projecting through said opening in the other of said one of first position and said second position, said opening originally being closed by a frangible portion which is visually damaged upon a first movement of said nozzle element from said one of said first position and said second position to the other of said first position and said second position.

8. A liquid dispensing package according to claim 7 wherein said frangible portion is defined by a multiplicity of intersecting radial scores, said scores defining a circumferential series of triangular tabs, said tabs remaining with said top panel portion following rupturing of such scores as a result of said first movement of said nozzle element.

9. A package according to claim 1 wherein said finish portion has at least two circumferentially spaced apart slot openings therein, wherein said nozzle element has at least two circumferentially spaced apart pins projecting therefrom, each of said pins extending from said nozzle element into and through one of said slot openings in said finish portion, and wherein said annular skirt portion of said closure has at least two circumferentially spaced apart inclined grooves on an inside surface thereof, each of said inclined grooves receiving a free end portion of one of said pins.

10. A liquid dispensing package according to claim 2 wherein said package further comprises a fitment positioned within and frictionally engaging said finish portion of said container, said fitment having a main body portion and a spout extending from said main body portion toward said free end of said finish portion of said container, said spout having a free end;

wherein said spout of said fitment is received within said passage means of said nozzle element;

wherein said nozzle element has an annular sealing surface in its passage means; and wherein said sealing means comprises said free end of said spout, said free end of said spout sealingly engaging said annular sealing surface of said passage means of said nozzle element in said one of said first position and said second position.

11. A liquid dispensing package according to claim 10 wherein said container, including said finish portion, is formed integrally in a single piece from a thermoplastic material, wherein said nozzle element, including said at least one pin, is formed integrally in a single piece from a thermoplastic material, wherein said fitment, including said spout, is formed integrally in a single piece from a thermoplastic material, and wherein said cap element, including said top panel portion and said annular skirt portion, is formed integrally in a single piece from a thermoplastic material.

12. A liquid dispensing package according to claim 11 wherein fitment further comprises passage means extending therethrough, said passage means of said fitment permitting excess liquid dispensed from said container to drain back thereinto.

13. A liquid dispensing package according to claim 11 wherein said nozzle element has a recess in an inner end thereof, and wherein said fitment has a boss extending from an outer end thereof, said boss of said fitment being slidably received within said recess of said nozzle element at least in said one of said first position and said second position.

14. A liquid dispensing package according to claim 2 wherein said nozzle element comprises an annular recess in an outer surface thereof and a sealing fin projecting outwardly and downwardly from said nozzle element at a location further from a free of said finish portion of said container, wherein said sealing means comprises an annular bead of said container projecting radially inwardly from said finish portion, wherein said passage means of said nozzle element comprises radial passage means extending from said annular recess into said nozzle element and longitudinal passage means extending from said radial passage means to a free end of said nozzle element, said sealing fin of said nozzle element sealingly engaging said annular bead of said container in said one of said first position and said second position.

15. A liquid dispensing package according to claim 14 wherein said container, including said finish portion, is formed integrally in a single piece from a thermoplastic material, wherein said nozzle element, including said at least one pin, is formed integrally in a single piece from a thermoplastic material, and wherein said cap element, including said top panel portion and said annular skirt portion, is formed integrally in a single piece from a thermoplastic material.

* * * * *